US005951338A

United States Patent [19]

Seko et al.

[11] Patent Number: 5,951,338

[45] Date of Patent: Sep. 14, 1999

[54] COVER OF TERMINAL FITTING

[75] Inventors: Satomi Seko; Masamitsu Chishima, both of Yokkaichi, Japan

[73] Assignee: Sumitomo Wiring Systems, Ltd., Japan

[21] Appl. No.: 08/905,159

[22] Filed: Aug. 1, 1997

[30] Foreign Application Priority Data

Oct. 21, 1996 [JP] Japan ..... 8-278331
Mar. 26, 1997 [JP] Japan ..... 9-073787

[51] Int. Cl.[6] ..... H01R 13/00

[52] U.S. Cl. ..... 439/843

[58] Field of Search ..... 439/843, 839, 439/850, 851, 852, 842, 846, 745, 746, 747, 748, 749

[56] References Cited

U.S. PATENT DOCUMENTS

| | | | |
|---|---|---|---|
| 3,141,724 | 7/1964 | Raymond | 439/777 |
| 3,242,458 | 3/1966 | Raymond et al. | 439/851 |
| 3,247,315 | 4/1966 | Miller | 439/851 |
| 4,919,628 | 4/1990 | Mobley et al. | 439/852 |
| 4,938,720 | 7/1990 | Romak | 439/839 |
| 4,950,183 | 8/1990 | Watanabe et al. | 439/852 |
| 5,266,056 | 11/1993 | Baderschneider et al. | 439/745 |
| 5,281,175 | 1/1994 | Chupak et al. | 439/839 |
| 5,295,873 | 3/1994 | Walbrecht | 439/839 |
| 5,643,018 | 7/1997 | Sakai et al. | 439/852 |
| 5,716,244 | 2/1998 | Egenolf et al. | 439/843 |

FOREIGN PATENT DOCUMENTS

| | | |
|---|---|---|
| 36 29 740 | 3/1987 | Germany . |
| WO 89/05531 | 6/1989 | WIPO . |

*Primary Examiner*—Paula Bradley
*Assistant Examiner*—Tho D. Ta
*Attorney, Agent, or Firm*—Banner & Witcoff, Ltd.

[57] ABSTRACT

A cover 11 for an electrical terminal is formed by bending a stainless steel stamping into an angular tubular shape. A right side plate 15 of the cover 11 is formed so as to protrude above a plate face of an upper face plate 12, a lance 20 being formed on this plate face by shearing. This protruding portion serves as a stabilizer 17 which is formed in a stepped shape so as to be retracted inwards with respect to the outer face of the right side plate 15. The anterior and posterior ends of the upper face plate 12 have a pair of inserting members 22 formed thereon. The stabilizer 17 has a pair of fitting grooves 23 formed by cutting away into the protruding portion thereof. When the stamping is bent to the angular tubular shape, the inserting members 22 fit into the corresponding groove 23 to improve the stability of the cover, and without protruding beyond the right side plate 15.

10 Claims, 7 Drawing Sheets

COVER OF TERMINAL FITTING

TECHNICAL FIELD

The present invention relates to a cover for attachment to the exterior of an electrical terminal fitting.

BACKGROUND OF THE INVENTION

Miniaturized terminal fittings using thin metal sheet as material are employed in, for example, automobile communication signal lines where electrical wires with a relatively low amperage rating are used. A lance is deemed necessary in the terminal fitting for preventing removal after attachment in a connector housing; however, the thin metal sheet cannot give a sufficient stopping effect even if the side faces of the terminal fittings are cut away to form the lance. For this reason, as shown in FIG. 15 of this specification, the conventional terminal fitting of this type has a cover formed from stainless steel sheet, or the like, into an angular tubular shape. A lance 'c' is formed by cutting away a side face of the cover 'a', the cover 'a' being capable of being attached to the exterior of a terminal fitting 'b'. The stainless steel cover is stronger than the copper alloy usually used for the terminal fitting itself.

However, the conventional cover 'a' is formed by bending stainless steel sheet, and since the configuration is such that one end merely makes contact with a plate face of the other end, there are disadvantages, like the junction 'd' opening easily, etc., thereby weakening the shape supporting strength thereof. In the example shown in FIG. 15, since the overhanging member of the lance 'c' is in a free state, there is a problem in that the stopping force thereof is weak.

For these reasons, although soldering of the junction 'd' of the angular tube is often carried out in order to fix its position, since a separate soldering process must be provided, there is an inevitable increase in production cost.

The present invention has been developed after taking the above problems into consideration, and aims to present a terminal fitting cover with a superior shape supporting strength, and which can be produced at a low cost.

SUMMARY OF THE INVENTION

According to the invention there is provided a tubular metal cover for an electrical terminal, the cover being folded from sheet material and having abutting sides, an insertion member of one side being engageable in a receiving member of the other side as the cover is formed.

Such a cover ensures that the abutting edges are restrained without the need for soldering of the junction. Further support may be provided when the cover and terminal assembly are inserted into a connector housing.

Preferably, one edge of the cover comprises an upstanding stabilizer or flange for insertion in a groove of the connector housing. This stabilizer preferably includes the receiving member and is stepped inwardly so that protrusion of the insertion member is not beyond the outer side face of the other side. In this way an undercut of the connector housing can be avoided.

The insertion member is preferably a projection in the plane of the sheet material whereas the receiving member can be an edge recess or aperture at the other side. The insertion member, receiving member, or both, can be deformable to latch them together, thus forming a strong self-supporting cover.

BRIEF DESCRIPTION OF DRAWINGS

Other features of the invention will be apparent from the following description of preferred embodiments shown by way of example only in the accompanying drawings in which.

DESCRIPTION OF PREFERRED EMBODIMENT

A first embodiment of the present invention relating to a terminal fitting cover is explained hereinbelow, with reference to FIGS. 1 to 8.

Figure 1:
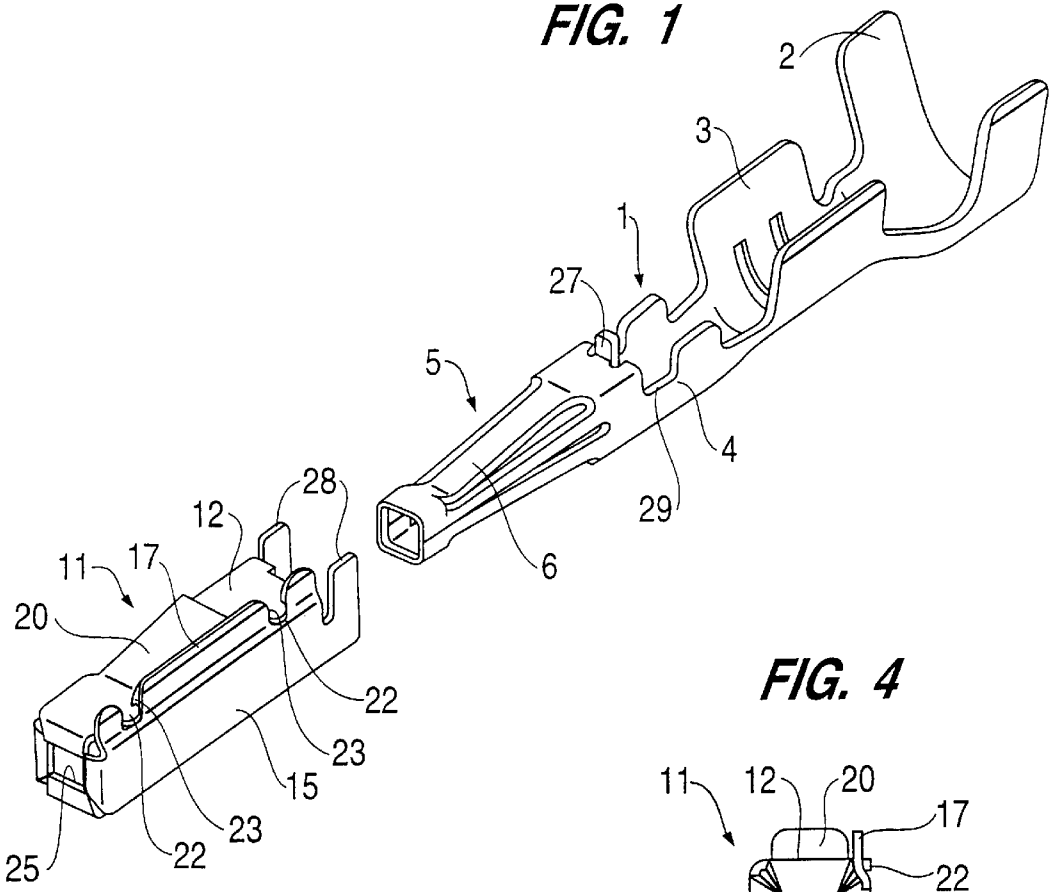
FIG. 1 is a diagonal view of a cover of a first embodiment and a female terminal fitting.
Figure 2:
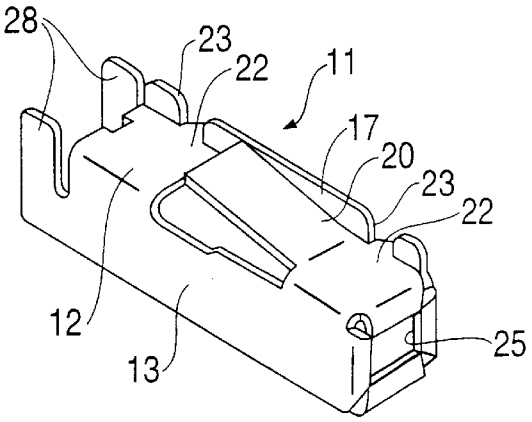
FIG. 2 is a diagonal view from the opposite side of the cover.
Figure 3:
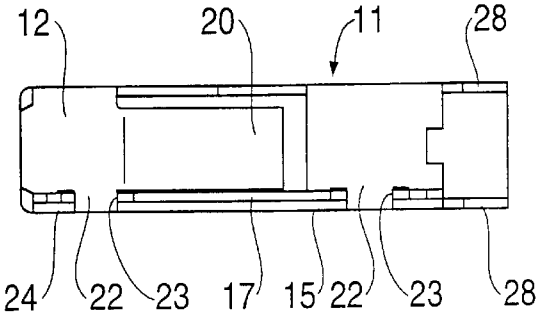
FIG. 3 is a plan view of the cover.

A female terminal fitting 1 is formed from copper alloy sheet which has superior conductivity. After the sheet is stamped out, bending is carried out in sequence, and as a result, the form shown in FIG. 1 is achieved. From the posterior end, the following are provided in a unified manner: an insulation barrel 2 to which the end 9 of an electric wire 8 (see FIG. 8) is attached; a wire barrel 3 to which the end of a core wire 10 is attached; a connecting member 4; and an insertion member 5 into which a protruding member of a corresponding male terminal fitting (not shown) is inserted.

The insertion member 5 is partitioned into an upper and a lower portion, and forms an overall angular tubular shape that tapers off in the anterior direction. Its upper and lower faces have a pair of resilient contacts 6 that are formed so as to protrude inwards (see FIG. 7). Since the protruding member of the corresponding male terminal fitting is gripped between the resilient contacts 6 when it is inserted, electrical connectivity is established between the male and female terminal fittings.

Figure 5:
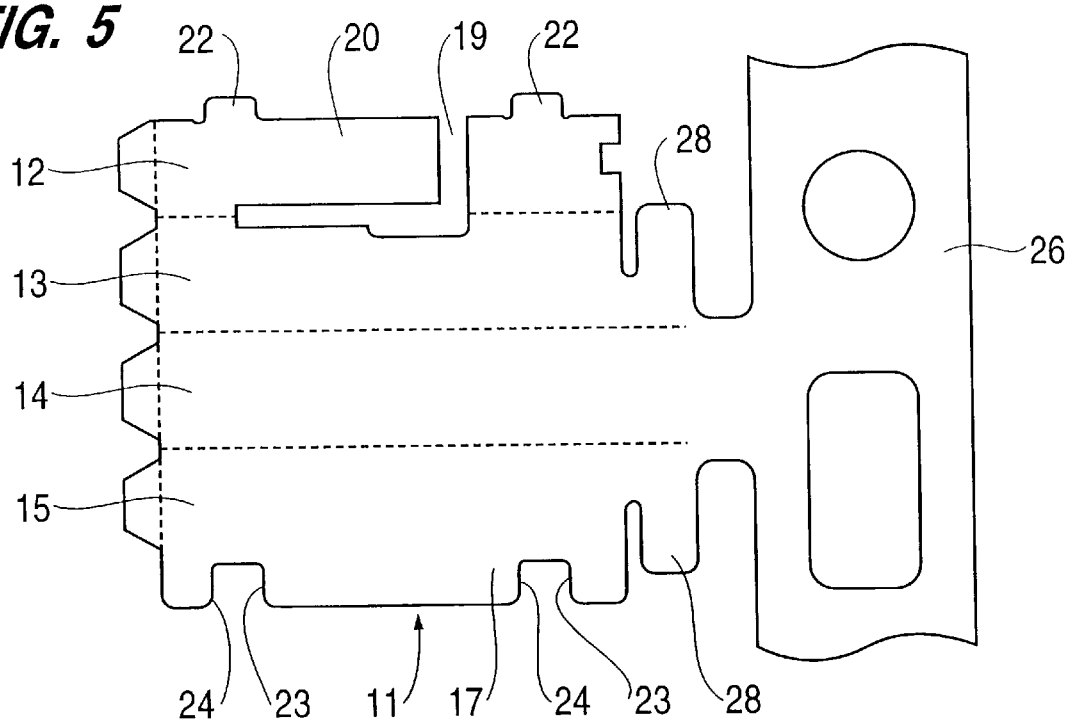
FIG. 5 is a plan view of the developed shape of the cover.

The cover 11 is arranged to be attachable to the exterior of the insertion member 5 of the female terminal fitting 1. This cover 11 is of stainless steel sheet and its overall shape is angular tubular, formed by bending from a stamping (FIG. 5). This stamping has, when seen from the top of the drawing downwards, the following parts in sequence: an upper face plate 12, a left side plate 13 (seen from a front face), a base face plate 14 and a right side plate 15. Bending lines are shown by broken lines in the drawing. The right side plate 15 has a greater width than the corresponding left side plate 13, the end portions of this right side plate 15 forming a stabilizer 17. Consequently, when bent, the end of the upper face plate 12 makes contact with the base end of the stabilizer 17. Further, the upper face plate 12 has an L-shaped slit 19 formed from its edge, thereby forming a lance 20 that faces posteriorly.

The anterior and posterior edges of the ends of the upper face plate 12 have a pair of inserting members 22 protruding therefrom. The anterior and posterior edges of the ends of the stabilizer 17 have a corresponding pair of fitting grooves 23 formed by cutting away. These fitting grooves 23 are cut-in to a position adjacent the base portion of the stabilizer 17, and are formed to be slightly narrower than the inserting members 22, mouths 24 widening in a tapering shape so as to provide a guiding function.

The production process of the cover 11 is as follows. First, as described above, the flat plate is stamped out (FIG. 5) and by means of several bending operations, the angular tubular shape is achieved. During this bending operation, the anterior end of the lance 20 is bent diagonally upwards, and the stabilizer 17 is formed in a diagonally stepped manner inwards with respect to the plate face of the right side plate 15. Furthermore, during the assembly, the inserting member 22 at the posterior end of the upper face plate 12 is inserted into the corresponding fitting groove 23 of the stabilizer 17 via the mouth 24. As this is taking place, the anterior end portions of all the plate faces 12–15 are bent inwards at right angles, and a through hole 25 is formed for inserting the contacting protruding member of the male terminal fitting. Finally, the cover 11 is separated from a carrier 26.

Figure 6:
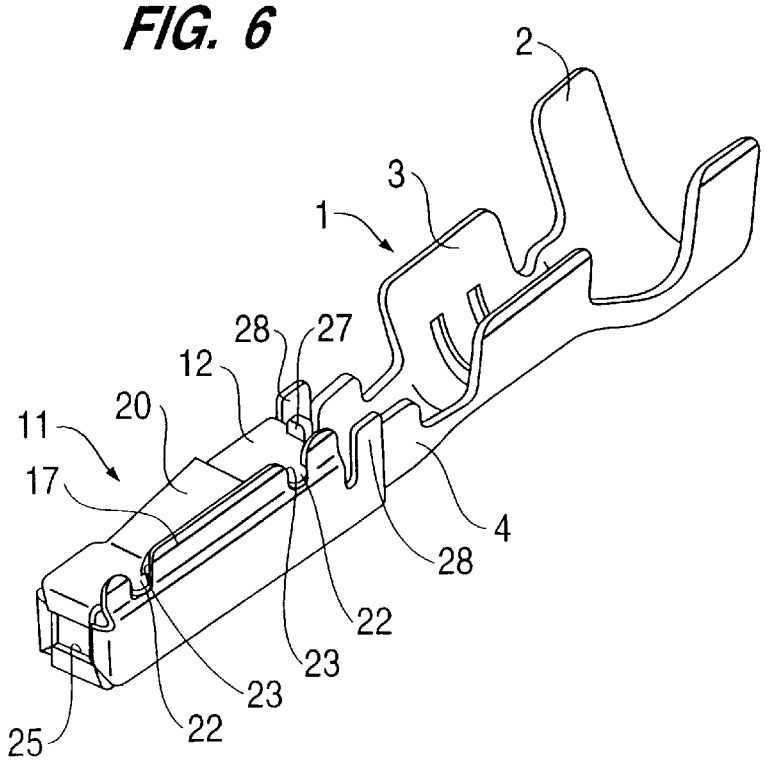
FIG. 6 is a diagonal view showing the cover fitted to a female terminal fitting.
Figure 7:
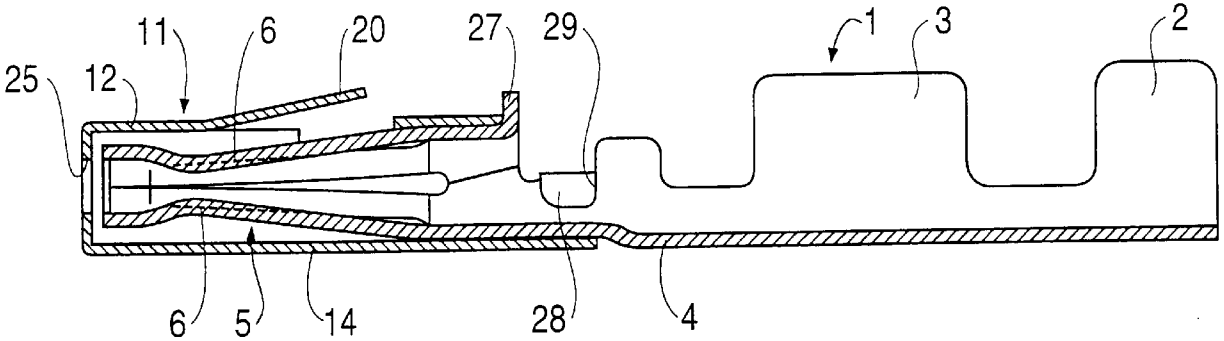
FIG. 7 is a vertical cross-sectional view showing the cover fixed to the female terminal fitting.

The cover 11, formed as described above, is inserted so as to cover the exterior of the insertion member 5 from the anterior end of the female fitting 1. As shown in FIG. 6, the posterior edge of the upper face plate 12 of the cover 11 is prevented from being pushed in further by its making contact with a protruding member 27 formed so as to rise upwards from the posterior end of the upper face of the insertion member 5. Further, as shown in FIG. 7, stopping members 28, formed on the posterior ends of the left and right side plates 13 and 15 of the cover 11, are bent inwards into a groove 29 formed in the connecting member 4 of the female terminal fitting 1, thereby fixing the cover 11 with the female terminal fitting 1. In this manner, resilient contacts 6 are protected.

Figure 8:
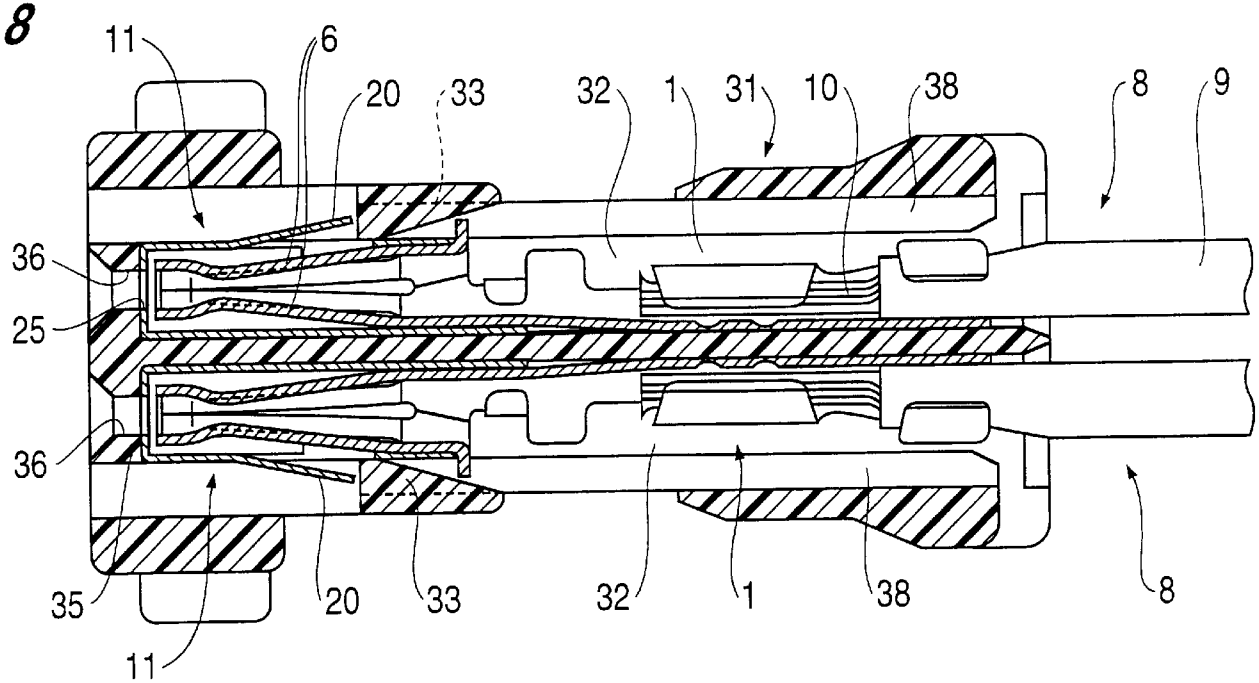
FIG. 8 is a cross-sectional view of a connector housing having a terminal fitting housed therein.

The insertion of the female terminal fitting 1 into a connector housing 31 is now described based on FIG. 8. The connector housing 31 is made of synthetic resin, and its interior has cavities 32 provided at an upper and lower level. The cavities 32 have stopping protrusions 33 for stopping the lance 20, an anterior face wall 35 of the cavity 32 having a through hole 36 which allows the insertion of the protruding contacting member of a male terminal fitting.

Thus, the female terminal fitting 1 has the cover 11 fitted and fixed thereto, and the electric wire 8 is fixed to the barrels 2 and 3. The female terminal fitting 1 is inserted from the posterior end into the cavity 32 of the connector housing 31, and during this insertion, the stabilizer 17 provided in the cover 11 is pushed so as to become aligned with a guiding groove 38 provided in the cavity 32, and is thereby inserted smoothly. Once it is inserted up to a specified position, the lance 20 is stopped by the stopping protrusion 33 of the cavity 32, thereby retaining it in an unremovable condition. The through hole 25 of the cover 11 is located immediately behind the through hole 36 at the anterior face of the cavity 32.

The inserting members 22 are pushed into the fitting grooves 23 and thus the shape supporting strength is high, so that it is not damaged too easily. Further, when it is attached to the female terminal fitting 1, the lance 20 provided therein can also perform a satisfactory stopping function, and the protection of the resilient contact 6 is also carried out with certainty. Moreover, since the operation of insertion of the inserting member 22 into the fitting groove 23 is carried out simultaneously with the bending operation thereof into an angular tabular shape, it becomes unnecessary to set up a subsequent process, and production can be carried out without incurring an increase in cost.

Figure 4:
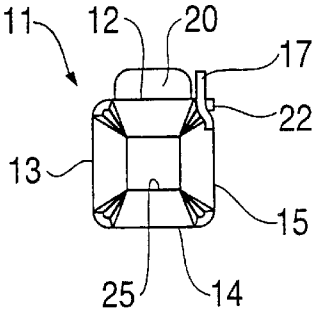
FIG. 4 is a front view of the cover.

By providing the stabilizer 17 on the cover 1, the insertion operation of the female cavity 32 can be carried out smoothly. Since the terminal fitting 1 into the stabilizer 17 is formed in a stepped manner and is retracted inwards with respect to the right side plate 15 of the cover 11, the anterior end of the inserting member 22 inserted into the fitting groove 23 can be positioned in a retracted location with respect to the plate face of the right side plate 15 (FIG. 4). For this reason, it becomes unnecessary to make design changes such as providing concave cut-away grooves on the inner wall of the cavity 32.

Figure 9:
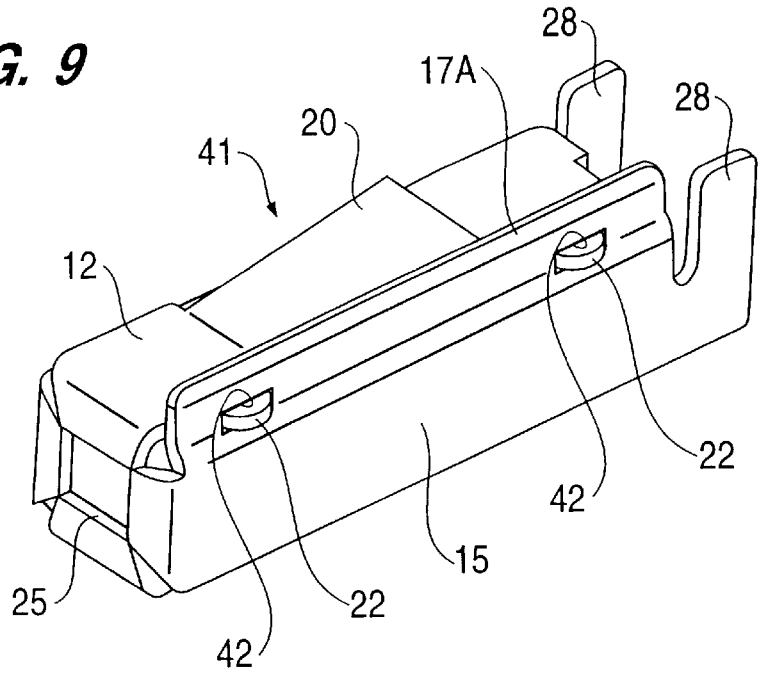
FIG. 9 is a diagonal view showing a cover of a second embodiment.
Figure 10:
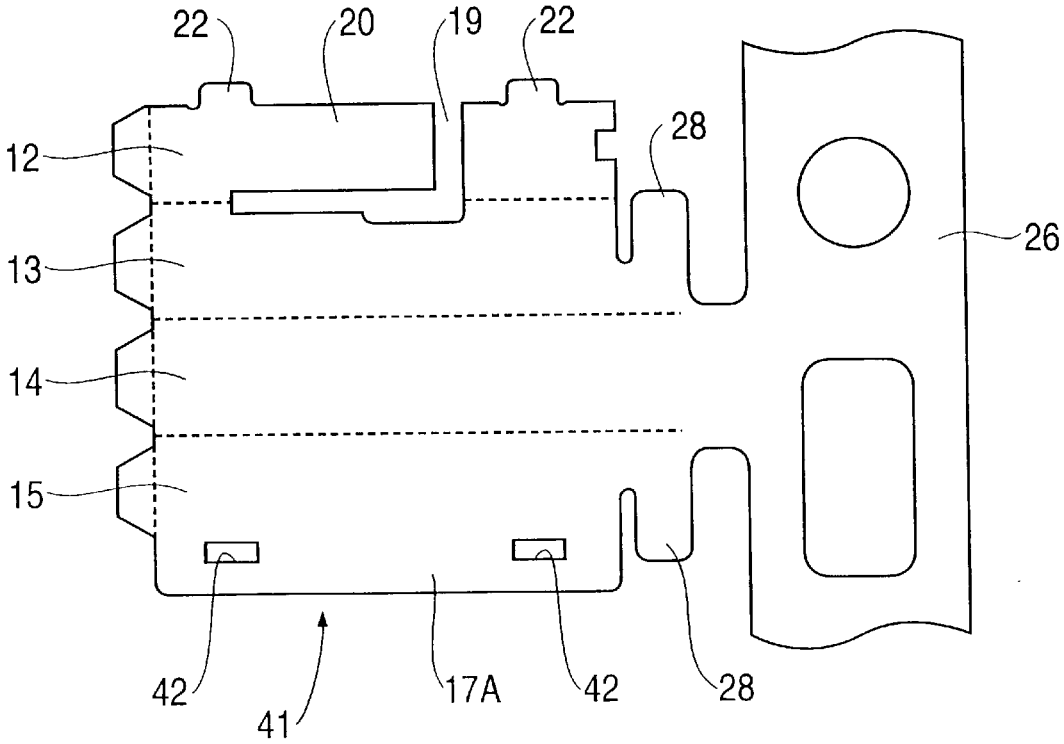
FIG. 10 is a plan view of the developed shape of the cover of FIG. 9.

A second embodiment of the present invention is explained with the aid of FIGS. 9 to 10.

As shown in the developed shape in FIG. 10, a cover 41 of this embodiment has, instead of the fitting grooves 23 of the first embodiment, window holes 42 formed so as to correspond with inserting members 22, the inserting members 22 fitting tightly therein and the window holes 42 being formed on a plate face of a base portion of a stabilizer 17A. Further, an angular portion of the anterior end of the inserting member 22 is rounded so as to facilitate smooth insertion into the window hole 42. Since the configuration of the other parts is the same as in the first embodiment, the same numbers are accorded to parts having the same configuration as in the first embodiment, and an explanation thereof omitted.

During the bending operation, the inserting members 22 at the anterior and posterior ends of the upper face plate 12 are inserted into the corresponding window holes 42 located on the base end portion of the stabilizer 17A. The cover 41 shown in FIG. 9 is thereby formed.

In this cover 41 as well, since the assembly is carried out simultaneously with the inserting members 22 being inserted into the window holes 42, the shape supporting strength is high and the lance 20 performs a satisfactory stopping function, the protection of resilient contacts 6 also being effected. Since the operation of inserting the inserting members 22 into the window holes 42 is carried out simultaneously with the operation of bending the cover 41 into an angular shape, production can be carried out at low cost. Further, by providing the stabilizer 17A on the cover 41, the insertion operation of the female terminal fitting 1 into the cavity 32 can be carried out smoothly. Moreover, since the stabilizer 17A is formed to be stepped in its interior side, the anterior end of the inserting member 22 inserted into the window hole 42 can be housed in a location that is retracted with respect to the plate face of the right side plate 15, thereby being advantageous in a likewise manner by making it unnecessary to provide concave cut-away grooves on the inner wall of the cavity 32.

Figure 11:
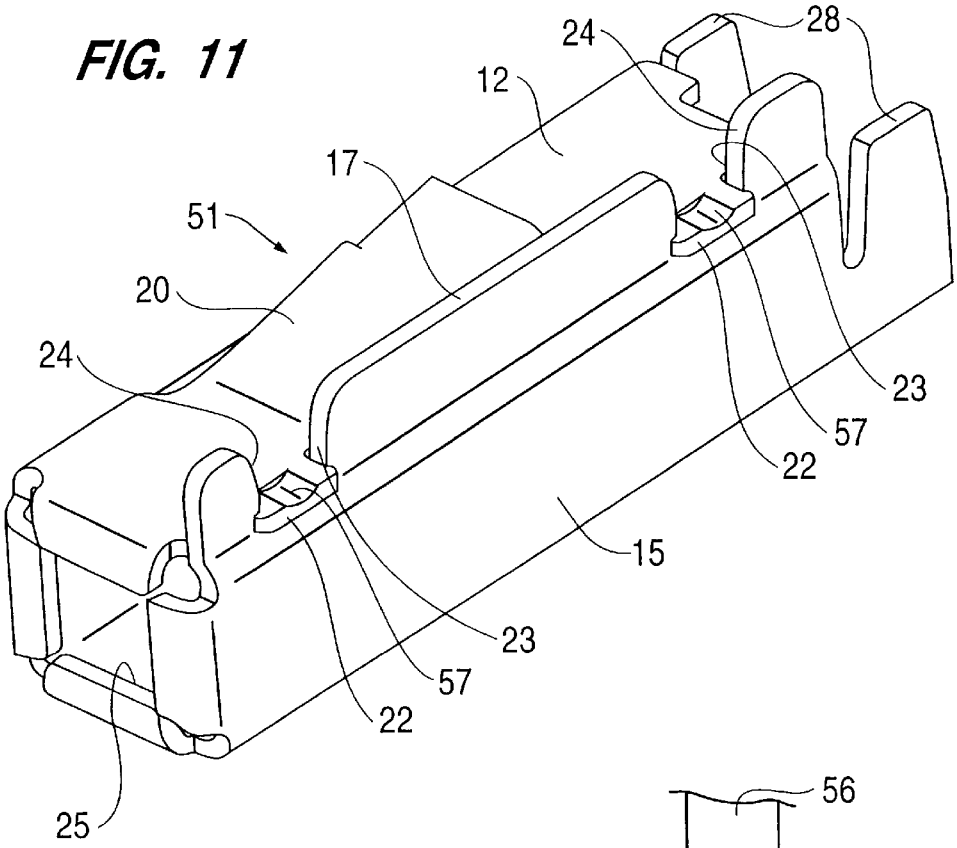
FIG. 11 is a diagonal view of a cover of a third embodiment.
Figure 12:
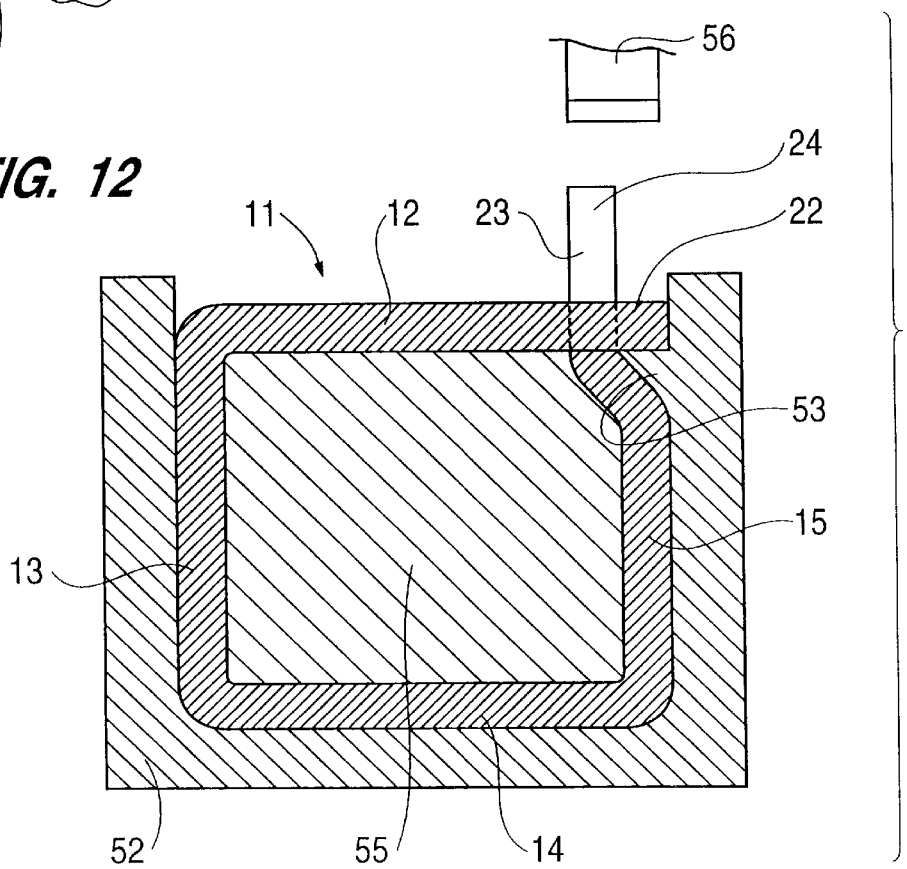
FIG. 12 is a cross-sectional view explaining the pressing-in process.
Figure 13:
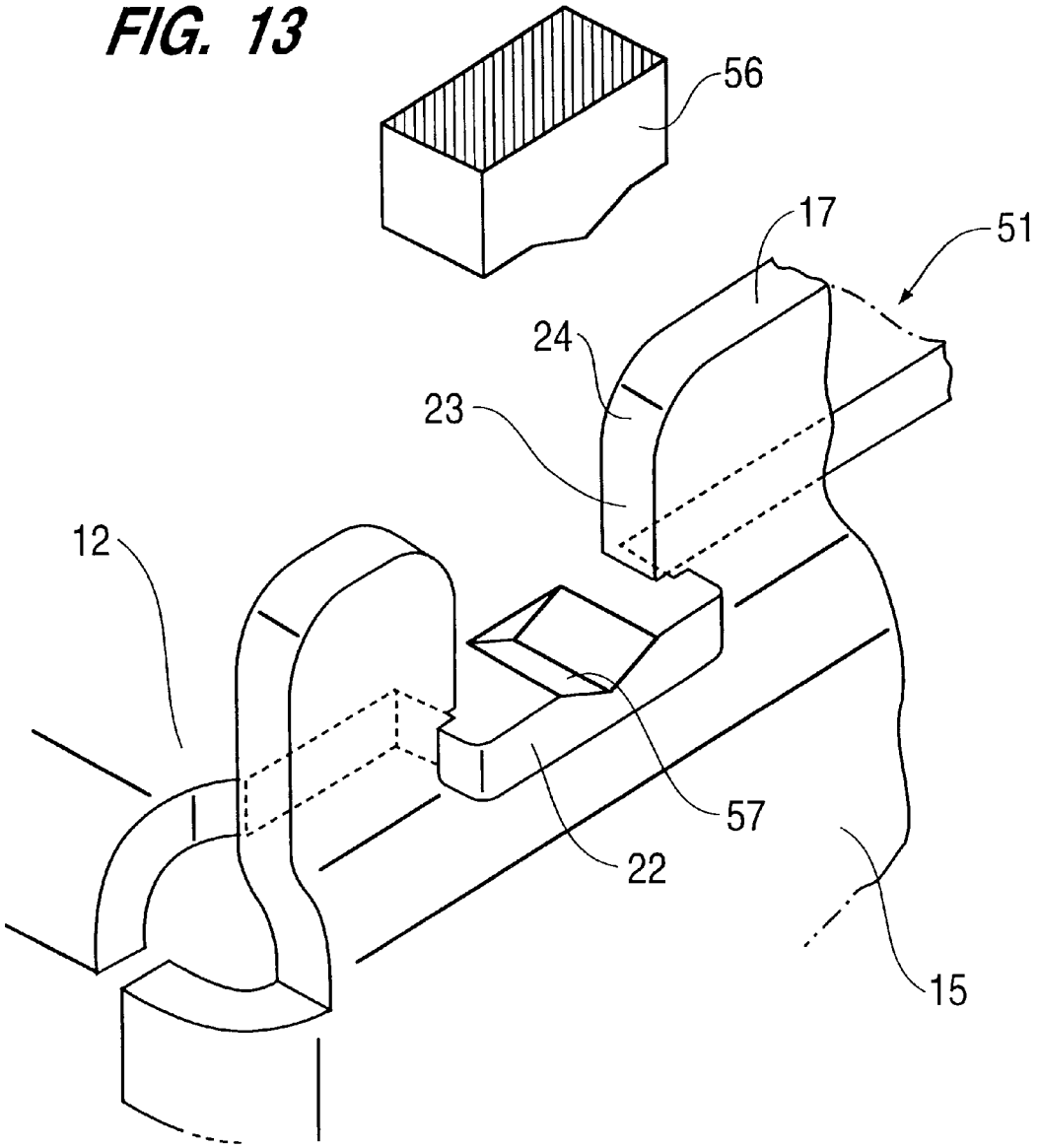
FIG. 13 is a partially enlarged diagonal view showing an exaggerated pressed-in state of the inserting member and the receiving member.

A third embodiment of the present invention is explained with the aid of FIGS. 11 to 13.

This embodiment further strengthens the fixing strength of the pressed-in portion constituted by the fitting groove 23 and the inserting member 22 of the first embodiment. Since the configuration of the other parts is the same as in the first embodiment, the same numbers are accorded to parts having the same configuration as in the first embodiment, and an explanation thereof omitted.

A cover 51 of the third embodiment is assembled in the same manner as the first embodiment, and furthermore, an inserting member 22 is pressed in so as to ensure that the fitting groove 23 and the inserting member 22 fit into each other, thereby strengthening the attachment of the fitting groove 23 and the inserting member 22.

The pressing in is carried out as follows. First, the cover 11 which has been assembled up to the point described in the first embodiment is inserted into a jig 52 from its posterior end, the jig 52 being open only from above. The cover 11 is thus housed tightly and supported therein, thereby controlling the movement of the cover 11 in an outward direction. That is, as shown in FIG. 12, the base face of the jig 52 and the left and right side faces are fitted tightly with a base plate 14, a left side plate 13 and a right side plate 15 of the cover 11.

The upper edge portion of the right side face of the jig 52 forms an overhanging portion 53 that protrudes so as to fit tightly with the stepped portion retreated inwards from the boundary between the right side plate 15 and the stabilizer 17. The upper face of the overhanging member 53 makes tight contact with the lower face of the inserting member 22 and receives and supports the inserting member 22 from below. Further, the interior of the cover 11 has a core 55 inserted therein from the posterior side, the core 55 making tight contact with the interior faces. The core 55 prevents a change of shape of the cove 11 in the inward direction.

After setting up the cover 11 as described above, the upper face of the inserting member 22 is pressed in by means of a punch 56. When this is clone, the center of the upper face of the inserting member 22 becomes concave, the anterior and posterior external edges of the inserting member 22 getting pressed towards the inner side edges of the fitting groove 23, this pressing-in occurring only to the extent of the amount of change of shape of a concave portion 57. In this way, as shown in an exaggerated manner in FIG. 13, both the inner side of the fitting groove 23 and the outer side of the inserting member 22 become concave and undergo a change in shape so as to fit tightly into each other. After this pressing-in operation has been performed, the core 55 is taken out from the posterior end, and the cover 51 is taken out from the jig 52 from the posterior end.

Figure 14:
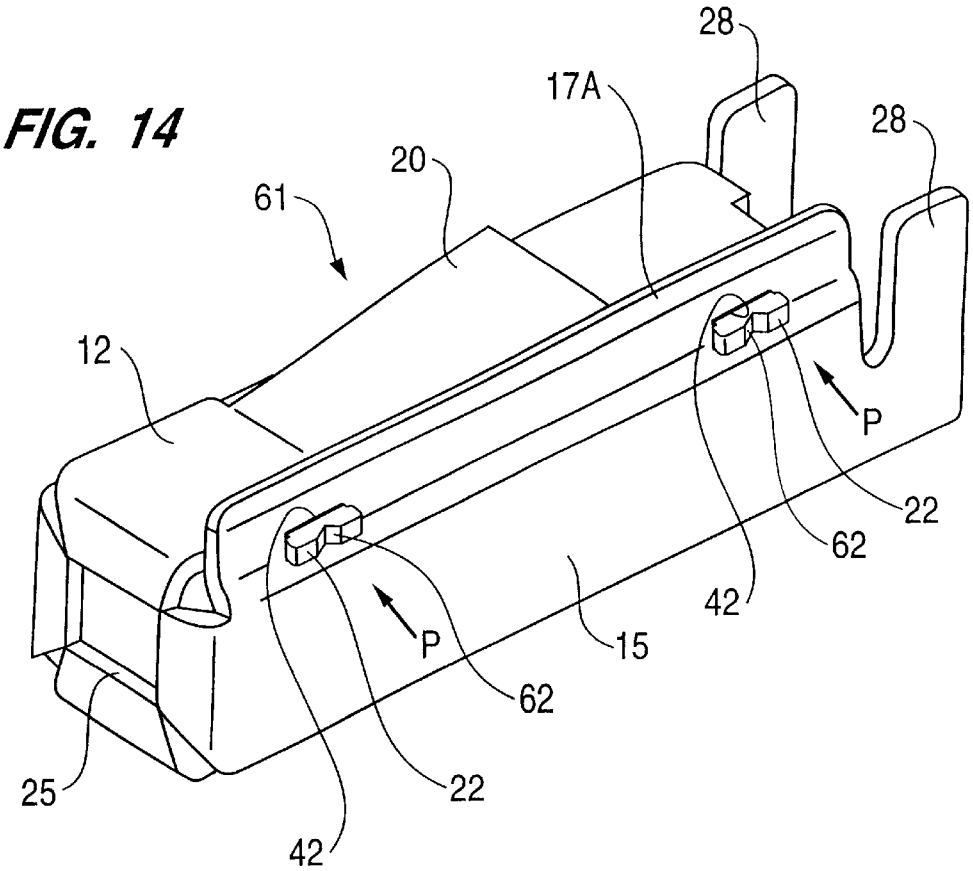
FIG. 14 is a diagonal view of a cover of a fourth embodiment.
Figure 15:
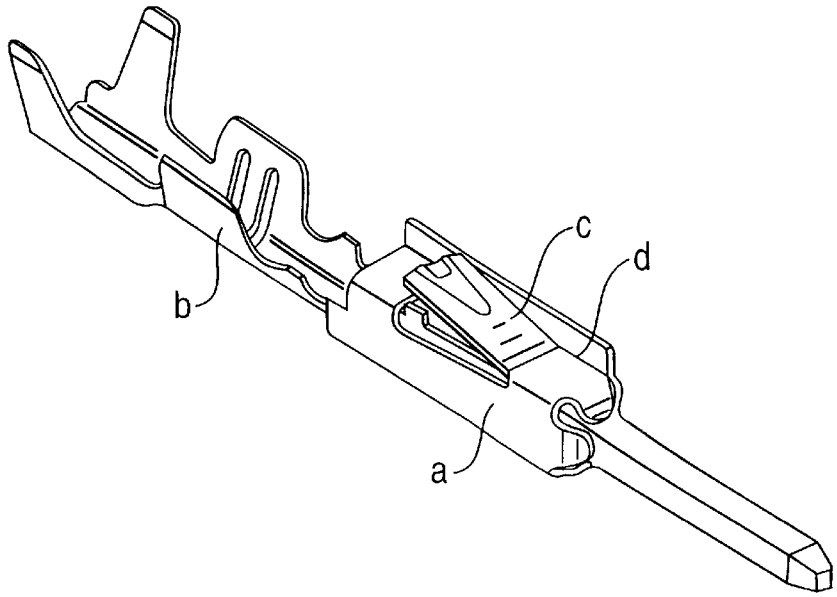
FIG. 15 (PRIOR ART)
FIG. 15 is a diagonal view of a male terminal having a prior art cover attached thereon.

Next, a fourth embodiment of the present invention is described with the aid of FIG. 14.

The fourth embodiment further strengthens the attachment strength of the pressed-in portion of the window hole 42 and the inserting member 22 in the cover 41 of the second embodiment. Since the configuration of the other parts is the same as in the second embodiment, the same numbers are accorded to parts having the same configuration as in the first embodiment, and an explanation thereof omitted.

A cover 61 of this embodiment is assembled in the same manner as the first embodiment, and furthermore, an inserting member 22 is pushed in so as to make a window hole 42 and the inserting member 22 fit into each other, thereby strengthening the attachment of the window hole 42 and the inserting member 22.

During the pressing-in operation, the cover 41 of the second embodiment is housed and supported in a jig (not shown), the upper face of the jig being open. A portion of the inserting member 22 protruding from a stabilizer 17A is pressed in by means of a punch (not shown) in a direction indicated by the arrow P in FIG. 14 to spread the edges thereof.

A central portion of the outer side of the inserting member 22 thus gets pressed in so as to form a concave portion 62 thereon.

As is the case in the third embodiment, the cover 61 of the present embodiment also has a window hole 42 and the inserting member 22 fitted together by means of a pressing-in operation. Accordingly, compared to the cover 41 of the second embodiment, the shape supporting strength is further increased.

The possibilities described below also lie within the technical range of the present invention.

(1) Although in the above embodiments a cover is fitted to a female terminal fitting, it is possible to attach a cover to a male terminal fitting as well in order to provide a lance. The present invention equally applies in such a cover as well.

(2) In the third embodiment, although the inserting member 22 is made to undergo a change in shape, according to the present invention, it may equally be arranged so that both the inserting member 22 and the fitting groove 23 or only the fitting groove 23 is made to undergo a change in shape. In such a case, at the end portion of the right side plate 15, the anterior end having the fitting groove 23 at the anterior side is pressed in from the front and made to fit into the inserting member 22. Further, the posterior end having the fitting groove 23 at the posterior end is pushed in from the rear and made to fit in with the inserting member 22.

(3) In the fourth embodiment, although the inserting member 22 is made to undergo a change in shape, according to the present invention, either both the inserting member 22 and the window hole 42 or only the window hole 42 may be made to change shape in this manner. In this case too, as in the above embodiment, in the end portion of the right side plate 15, the anterior end having the anterior window hole 42 and the posterior end having the posterior window hole 42 are respectively pressed in anteriorly and posteriorly and made to fit into the inserting members 22.

We claim:

1. A tubular metal cover for an electrical terminal, the cover being folded from sheet material and having sides to enclose a portion of the terminal, a flange projecting outward from one of said sides and being stepped inward to be between a pair of generally parallel sides defining a width of the cover, an insertion member on one side and a receiving member on said flange engaging said insertion member as the cover is formed to secure the cover in a closed condition about the terminal.

2. A cover according to claim 1 wherein said flange includes a distal edge and said receiving member is a groove open in said distal edge of said flange.

3. A cover according to claim 1 wherein said receiving member is an aperture in said flange.

4. A cover according to claim 1 wherein the cover has spaced pairs of insertion members and receiving members.

5. A cover according to claim 1 wherein the insertion member comprises a projection and the receiving member comprises a groove to receive said projection, and wherein said flange is adapted to act as a stabilizer during insertion of said cover in a connection housing.

6. A cover according to claim 5 wherein the cover is rectangular in section and the flange is generally parallel to the side from which the flange extends.

7. A cover according to claim 6 wherein the receiving member is formed in the flange, and the insertion member projects through the receiving member of the flange, but not beyond the side from which the flange extends.

8. A cover according claim 1 wherein the insertion member is latchable in the receiving member by deformation of said insertion member or said receiving member.

9. A cover according to claim 8 wherein the insertion member is deformable to latch with the receiving member.

10. A cover according to claim 8 wherein the receiving member is deformable to latch with the inserting member.

* * * * *